US012296371B2

(12) United States Patent
Rukat

(10) Patent No.: US 12,296,371 B2
(45) Date of Patent: May 13, 2025

(54) CAN BODYMAKER RAM ALIGNMENT

(71) Applicant: CROWN PACKAGING TECHNOLOGY, INC., Alsip, IL (US)

(72) Inventor: Bronislaw Rukat, West Yorkshire (GB)

(73) Assignee: CROWN PACKAGING TECHNOLOGY, INC., Alsip, IL (US)

( * ) Notice: Subject to any disclaimer, the term of this patent is extended or adjusted under 35 U.S.C. 154(b) by 282 days.

(21) Appl. No.: 16/319,848

(22) PCT Filed: Jul. 3, 2017

(86) PCT No.: PCT/GB2017/051953
§ 371 (c)(1),
(2) Date: Jan. 23, 2019

(87) PCT Pub. No.: WO2018/020210
PCT Pub. Date: Feb. 1, 2018

(65) Prior Publication Data

US 2019/0262884 A1 Aug. 29, 2019

(30) Foreign Application Priority Data

Jul. 28, 2016 (GB) ..... 1613057

(51) Int. Cl.
*B21D 22/28* (2006.01)

(52) U.S. Cl.
CPC ..... *B21D 22/283* (2013.01)

(58) Field of Classification Search
CPC ..... B21D 22/00; B21D 22/20; B21D 22/28; B21D 22/283; B30B 15/146; B30B 15/0029; B30B 15/0035
USPC ..... 100/26.09
See application file for complete search history.

(56) References Cited

U.S. PATENT DOCUMENTS 223,029 A * 12/1879 Burkhardt ..... F16C 23/10 384/255
1,571,557 A * 2/1926 Paul ..... F16C 23/10 384/255
3,030,878 A * 4/1962 Holzer ..... B21D 24/005 100/237

(Continued)

FOREIGN PATENT DOCUMENTS

CN 1030371 A 1/1989
CN 1162278 A 10/1997

(Continued)

OTHER PUBLICATIONS

Merriam-Webster's online dictionary webpage containing the definition of "affix" (Year: 2023).*

*Primary Examiner* — Christopher L Templeton
*Assistant Examiner* — P Derek Pressley
(74) *Attorney, Agent, or Firm* — Condo Roccia Koptiw LLP

(57) ABSTRACT

A can bodymaker comprising: a ram; a drive mechanism; a yoke coupling the ram to the drive mechanism in order to drive the ram with a linear, reciprocating motion; a yoke slide fixed relative to the can bodymaker, the yoke being confined by the yoke slide to move in a linear direction; and an alignment mechanism for aligning a yoke-coupled end of the ram with respect to the yoke within a plane perpendicular to said linear direction.

13 Claims, 11 Drawing Sheets

(56) References Cited

U.S. PATENT DOCUMENTS

| | | | | | |
|---|---|---|---|---|---|
| 3,603,248 | A | * | 9/1971 | Nouel | B29C 45/6714 100/269.09 |
| 3,889,509 | A | | 6/1975 | Miller et al. | |
| 4,173,138 | A | * | 11/1979 | Main | B21D 22/28 72/449 |
| 4,934,167 | A | | 6/1990 | Grims et al. | |
| 5,454,253 | A | | 10/1995 | Mueller | |
| 9,079,237 | B2 | * | 7/2015 | Fleischer | B21D 22/283 72/349 |
| 2014/0260500 | A1 | | 9/2014 | Fleischer et al. | |
| 2015/0059429 | A1 | | 3/2015 | Butcher et al. | |

FOREIGN PATENT DOCUMENTS

| | | | |
|---|---|---|---|
| CN | 101074701 | A | 11/2007 |
| CN | 202240613 | U | 5/2012 |
| CN | 103687680 | A | 3/2014 |
| CN | 105008061 | A | 10/2015 |
| CN | 105473250 | A | 4/2016 |
| CN | 105689484 | A | 6/2016 |
| GB | 2143593 | A | 2/1985 |
| WO | WO 99/34942 | A1 | 7/1999 |
| WO | WO 2012/166331 | A1 | 12/2012 |

* cited by examiner

CAN BODYMAKER RAM ALIGNMENT

CROSS-REFERENCE TO RELATED APPLICATIONS

This application is the National Stage of International Application No. PCT/GB2017/051953 filed Jul. 3, 2017, which claims the benefit of GB application number 1613057.7, filed Jul. 28, 2016, the disclosures of which are incorporated herein by reference in their entirety.

TECHNICAL FIELD

The present invention relates to a can bodymaker with a ram alignment mechanism and to methods of aligning and adjusting a bodymaker ram.

BACKGROUND

In known bodymakers for the production of thin-walled metal cans by the so-called "drawing and wall-ironing" (DWI) process, cups are fed to the bodymaker and carried by a punch on the end of a reciprocating ram through a series of dies to obtain the desired size and thickness of the can. The series of dies may include a redraw die for reducing the diameter of the cup and lengthening its sidewall, and one or more ironing dies for wall-ironing a cup into a can body. Ultimately, the can body carried on the punch may contact a bottom forming tool so as to form a shape such as a dome on the base of the can. An exemplary bodymaker is described in WO9934942.

Alignment of known bodymakers is a time consuming process which requires production to be halted. The high volume nature of the can industry means that lost production time can be very costly for can producers. Additionally, alignment procedures for known bodymakers require significant skill and attention to ensure that the machines can be operated safely and efficiently.

In setting up a can bodymaker the ram and its drive components are typically fixed in place on the machine bed. This roughly aligns the axis of the ram with other components of the bodymaker. Those other components, including for example the redraw and ironing dies and a domer, are then aligned with the ram. If the level of misalignment of the ram is great, it may be necessary to reposition a bodymaker cradle within which the dies are fixed, which in turn means that the components within the cradle must be aligned again.

SUMMARY OF THE INVENTION

A can bodymaker comprising: a ram; a drive mechanism; a yoke coupling the ram to the drive mechanism in order to drive the ram with a linear, reciprocating motion; a yoke slide fixed relative to the can bodymaker, the yoke being confined by the yoke slide to move in a linear direction; and an alignment mechanism for aligning a yoke-coupled end of the ram with respect to the yoke within a plane perpendicular to said linear direction.

The alignment mechanism may comprise: an inner bushing supporting the ram, the inner bushing being annular and having eccentric inner and outer surfaces; an outer bushing supporting the inner bushing, the outer bushing being annular and having eccentric inner and outer surfaces; and an adjustment mechanism for independently rotating the inner and outer bushings about respective axes of rotation defined by their outer surfaces.

The axes of rotation of the inner and outer bushings may be separated by a distance between 0.10 mm and 0.30 mm and preferably 0.25 mm. The ram axis and the rotational axis of the inner bushing may be separated by a distance between 0.10 mm and 0.30 mm and preferably 0.25 mm.

The adjustment mechanism may comprise a first worm gear for rotating the inner bushing and a second worm gear for rotating the outer bushing.

The can bodymaker may comprise a locking mechanism for securing the ram in the plane once positioned. The locking mechanism may comprise a compression coupling arranged axially about the bushings. For example, the can bodymaker may comprise a nut for locking the ram in position with respect to the yoke, the nut being threaded on to the ram.

The yoke may allow adjustment of the yoke-coupled end of the ram with respect to the drive mechanism along the linear direction associated with the reciprocating motion of the ram.

The yoke may be coupled to the ram by a threaded rod screwed into a tapped hole, the yoke allowing adjustment of the yoke-coupled end of the ram with respect to the drive mechanism along the linear direction by screwing the threaded rod into or out of the tapped hole.

The can bodymaker may further comprise an insert, such as a washer or a shim, located between the yoke-coupled end of the ram and the yoke. The insert is preferably formed from an elastomeric material such as PTFE.

The can bodymaker may comprise a bottom forming tool located at an end of the can bodymaker opposite the drive mechanism.

According to a second aspect of the present invention there is provided a method of aligning a ram of a can bodymaker. The can bodymaker has a yoke coupling the ram to a drive mechanism in order to drive the ram with a linear, reciprocating motion, and a yoke slide fixed relative to the can bodymaker. The yoke is confined by the yoke slide to move in a linear direction. The method comprises using an alignment mechanism to position a yoke-coupled end of the ram with respect to the yoke within a plane perpendicular to the linear direction.

The use of the alignment mechanism may comprise rotating one or more of a pair of eccentrically nested bushings. The eccentrically nested bushings may be alternately rotated in an iterative sequence.

The method may comprise locking the ram in position with respect to the yoke once the yoke-coupled end of the ram is correctly positioned with respect to the yoke.

According to a third aspect of the present invention there is provided a yoke for a can bodymaker. The yoke is configured to couple a ram to a drive mechanism in order to drive the ram with a linear, reciprocating motion. The yoke is further configured to fit within a yoke slide so that the yoke is confined to move in a linear direction. The yoke comprises an alignment mechanism for aligning a yoke-coupled end of the ram with respect to the yoke within a plane perpendicular to the linear direction.

The alignment mechanism may comprise: an inner bushing for supporting the ram, the inner bushing being annular and having eccentric inner and outer surfaces; an outer bushing supporting the inner bushing, the outer bushing being annular and having eccentric inner and outer surfaces; and an adjustment mechanism for independently rotating the inner and outer bushings about respective axes of rotation defined by their outer surfaces.

According to a fourth aspect of the present invention there is provided a can bodymaker. The can bodymaker comprises: a ram; a drive mechanism; a yoke coupling the ram to the drive mechanism in order to drive the ram with a linear, reciprocating motion; and a yoke slide fixed relative to the can bodymaker, the yoke being confined by the yoke slide to move in a linear direction. The coupling allows adjustment of the yoke-coupled end of the ram with respect to the drive mechanism along said linear direction.

The yoke may be coupled to the ram by a threaded rod screwed into a tapped hole, the yoke allowing adjustment of the yoke-coupled end of the ram with respect to the drive mechanism along the linear direction by screwing the threaded rod into or out of the tapped hole.

The can bodymaker may comprise an insert located between the yoke-coupled end of the ram and the yoke, the insert preferably being formed from a metal such as steel. Alternatively, the insert may be formed from an elastomeric material such as PTFE.

The can bodymaker may comprise a bottom forming tool located at an end of the can bodymaker opposite the drive mechanism.

According to a fifth aspect of the present invention there is provided a yoke for a can bodymaker. The yoke is further configured to fit within a yoke slide so that the yoke is confined to move in a linear direction. The yoke is further configured to allow adjustment of the yoke-coupled end of the ram with respect to the drive mechanism along said linear direction.

The yoke may comprise a threaded rod configured to screw into a tapped hole in the yoke-coupled end of the ram.

The yoke may comprise a tapped hole configured to allow a threaded yoke-coupled end of the ram to be screwed therein.

According to a sixth aspect of the present invention there is provided a method of aligning a ram of a can bodymaker. The can bodymaker has a yoke coupling the ram to a drive mechanism in order to drive the ram with a linear, reciprocating motion, and a yoke slide fixed relative to the can bodymaker. The yoke is confined by the yoke slide to move in a linear direction. The method comprises adjusting the yoke-coupled end of the ram with respect to the drive mechanism along the linear direction.

The yoke and the yoke-coupled end of the ram may be coupled by a threaded rod screwed into a tapped hole and adjusting the yoke-coupled end of the ram with respect to the drive mechanism along said linear direction may comprise screwing the threaded rod into or out of the tapped hole.

The method may comprise inserting or replacing an insert between the yoke-coupled end of the ram and the yoke.

The method may comprise locking the ram in position with respect to the yoke once the yoke-coupled end of the ram is correctly positioned with respect to the drive mechanism.

The can bodymaker may comprise a bottom forming tool located at an end of the can bodymaker opposite the drive mechanism. The yoke-coupled end of the ram may be adjusted with respect to the drive mechanism until the other end of the ram is aligned with respect to the bottom forming tool.

DETAILED DESCRIPTION

In order to address the problems associated with aligning a conventional bodymaker, embodiments described here allow the axis of the ram of the bodymaker to be accurately positioned, and in particular to be accurately positioned with respect to the bodymaker cradle.

Figure 1:
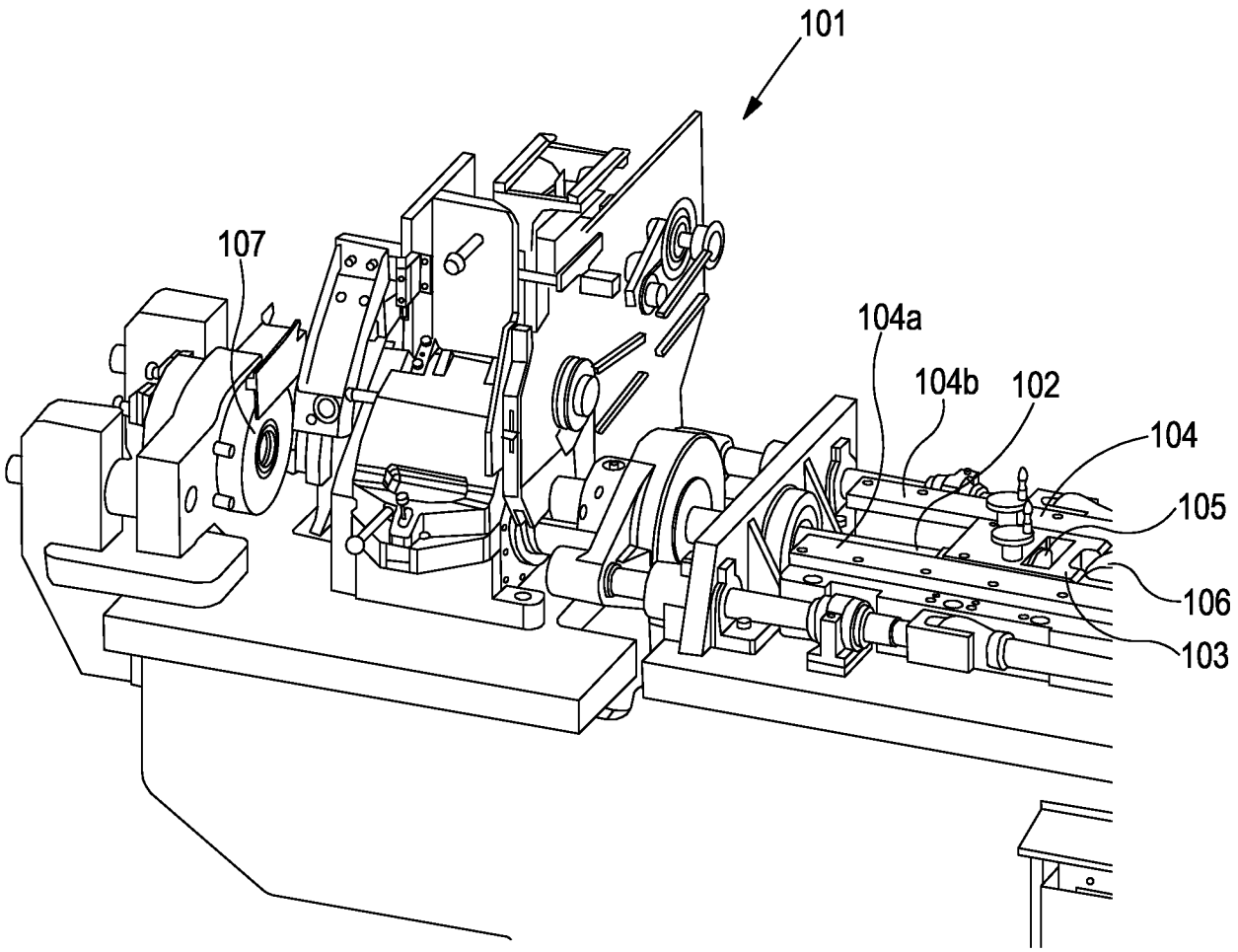
FIG. 1 is a perspective schematic view of a can bodymaker according to an embodiment of the invention.

FIG. 1 shows a perspective schematic view of a can bodymaker 101 for making can bodies from cups drawn from sheet metal. The bodymaker 101 comprises a ram 102, a drive mechanism (not shown), a yoke 103 and a yoke slide 104. A punch (not shown) is mounted on one end of the ram 102. In use, the ram 102 drives the punch to push a cup through the bodymaker 101 in order to form a can body. To form the base of the can, the punch then drives the can body into a bottom forming tool 107 fixed at the end of the bodymaker 101 opposite the ram 102. The other end of the ram 102 is attached to an adjustable yoke 103 and held against the yoke 103 by a flange 105. The yoke 103 is coupled to the drive mechanism by a drag link 106 in order to transfer a motive force to the ram 102. The yoke slide 104 comprises a pair of parallel rails 104*a,b* located on either side of the ram 102 and fixed relative to the bodymaker 101. The rails each have a U-shaped cross section, thereby forming a pair of slots in the rails 104*a,b*, the slots being directed towards the ram 102. The yoke 103 is provided with guidance blocks on either side (not shown, see FIG. 2). The yoke 103 is located between the rails 104*a,b* of the yoke slide 104 and the guidance blocks are received by the slots of the yoke slide 104 so that the yoke 103 is permitted to move only in a linear direction, parallel to the rails 104*a,b*.

Figure 2:
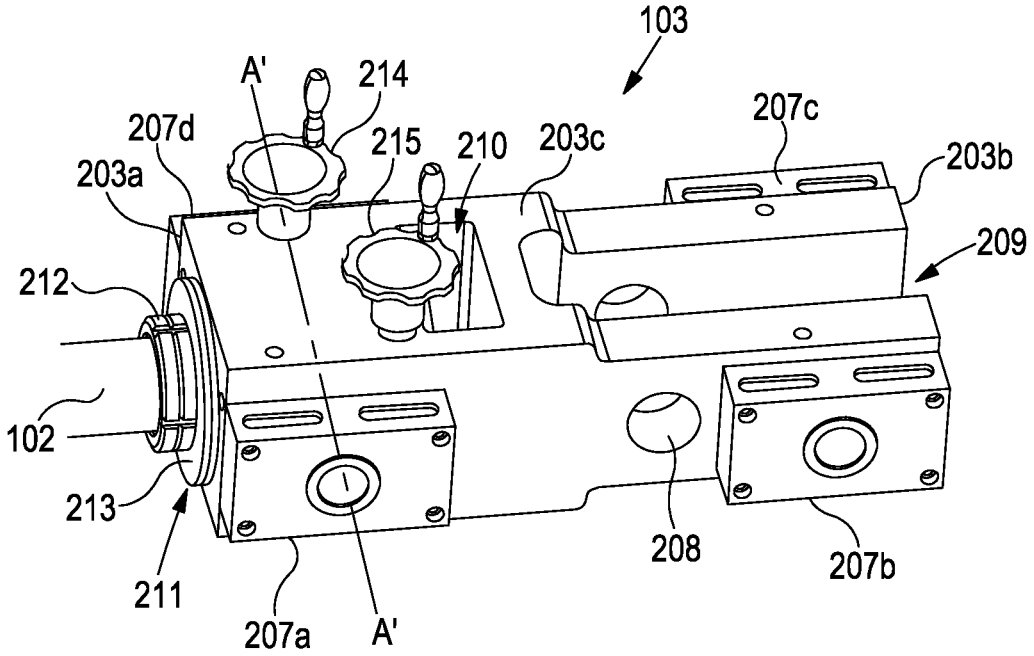
FIG. 2 is a perspective schematic view of the yoke of FIG. 1.

FIG. 2 shows a perspective schematic view of the yoke 103 of FIG. 1. The yoke 103 is of a generally rectangular box form with guidance blocks 207*a-d* fixed to either side. The yoke 103 comprises a ram-connecting end 203*a* and a slotted end 203*b*. The slotted end 203*b* comprises a bore 208 passing perpendicularly through the slot 209. When the yoke 103 is installed in the bodymaker 101, the drag link 106 is attached to the slotted end 203*b* using a pin (not shown) which passes through the bore 208, the pin allowing the motion of the drag link 106 to be transferred to the yoke 103. A rectangular passage 210 is provided through the top face 203*c* of the yoke 203 adjacent to the slot 209.

A main cylindrical bore (see FIG. 4) extends from the front face 203*a* of the yoke 103 and partway through the body of the yoke 103 such that a wall remains between the main cylindrical bore and the rectangular passage 210. A connecting cylindrical bore (see FIG. 4) is provided through the wall to join the main bore with the rectangular passage 210. A cylindrical alignment mechanism 211 is housed within the main cylindrical bore. The ram 102 is received through the centre of the alignment mechanism 211 and through the connecting cylindrical bore into the rectangular passage 210. The connecting bore is wider than the ram 102 to allow the end of the ram 102 to be radially positioned within the yoke 103. The end of the ram 102 is attached to a plug (see FIGS. 4 and 5) which has a flange 105 at one end. The flange is located in the rectangular passage 210 and has a larger diameter than the connecting bore, such that the ram 102 cannot be pulled from the yoke 103, but is small enough that the flange 105 can be moved radially within the rectangular passage 210 when the radial position of the ram 102 is adjusted.

A lock nut 212 is threaded on to the ram 102 adjacent to the front face 203*a* of the yoke 103. A faceplate 213 is provided between the lock nut 212 and the alignment mechanism 211. Tightening the lock nut 212 locks the position of ram 102 with respect to the yoke 103 and holds the faceplate 213 against the alignment mechanism 211, thereby avoiding excessive load on the alignment mechanism 211. A pair of removable handles 214, 215 may be attached to a top face 203*c* of the yoke 203 to facilitate adjustment of the alignment mechanism 211.

Figure 3:
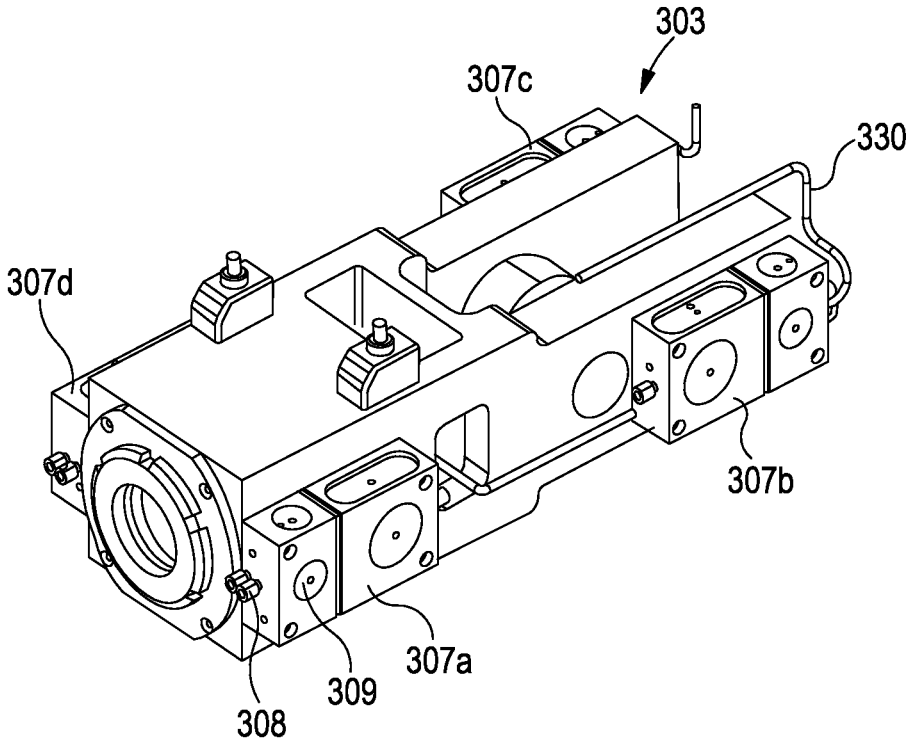
FIG. 3 is a perspective schematic view of a yoke according to an embodiment of the invention.

FIG. 3 shows a perspective schematic view of an adjustable yoke 303 which is similar to the adjustable yoke 103 shown in FIGS. 1 and 2. The guidance blocks 307*a-d* each have one or more fittings 308 attached to their ends and one or more small holes 309 in their side faces. The fittings are connected to a series of pipes 330 which can be used to supply lubricant (e.g. oil) to the guidance blocks 307*a-d*. When the yoke 303 is installed in the can bodymaker 101, lubricant passes through the guidance blocks 307*a,d* and leaks from the holes 309 to reduce friction between the guidance blocks 307*a-d* and the yoke slide 104.

Figure 4:
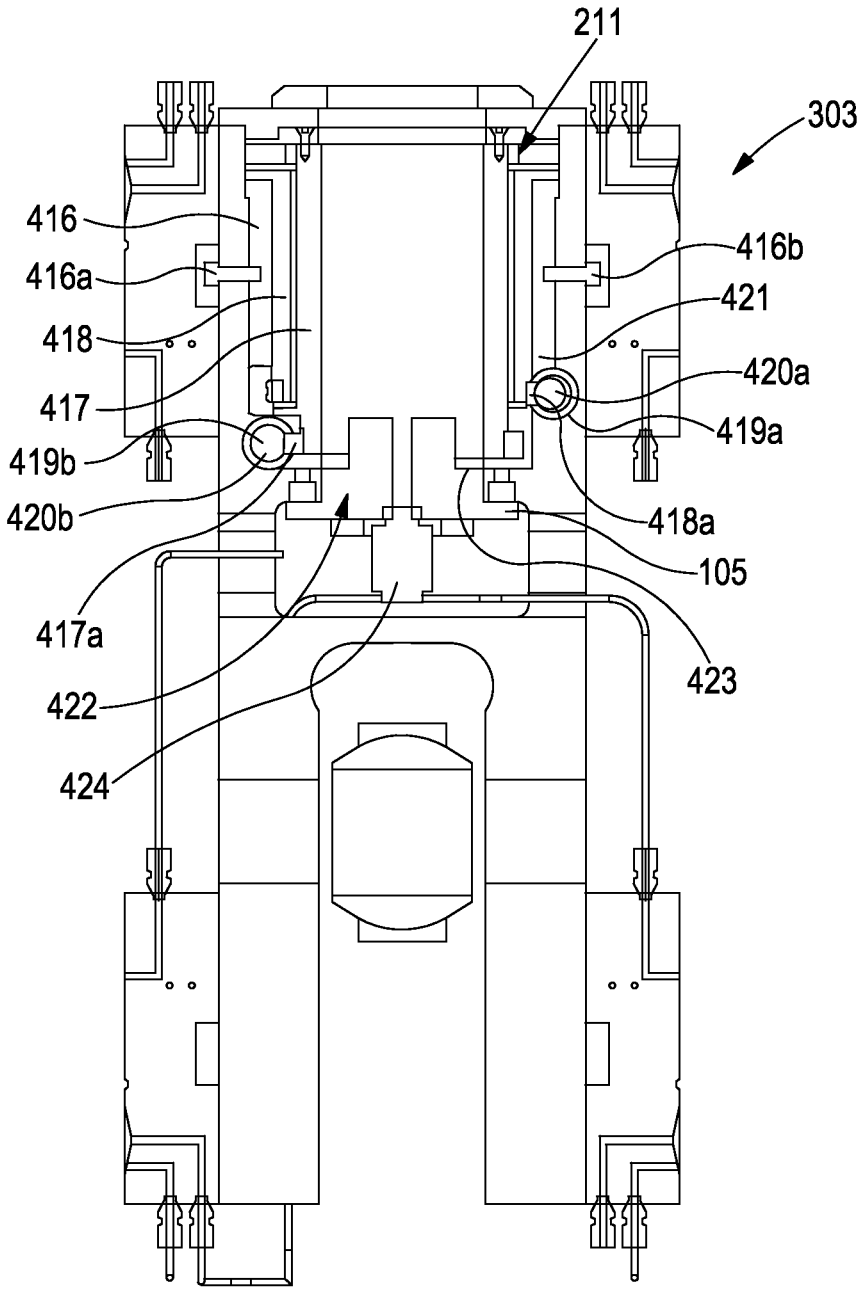
FIG. 4 is a horizontal section view through the yoke of FIG. 3.
Figure 5:
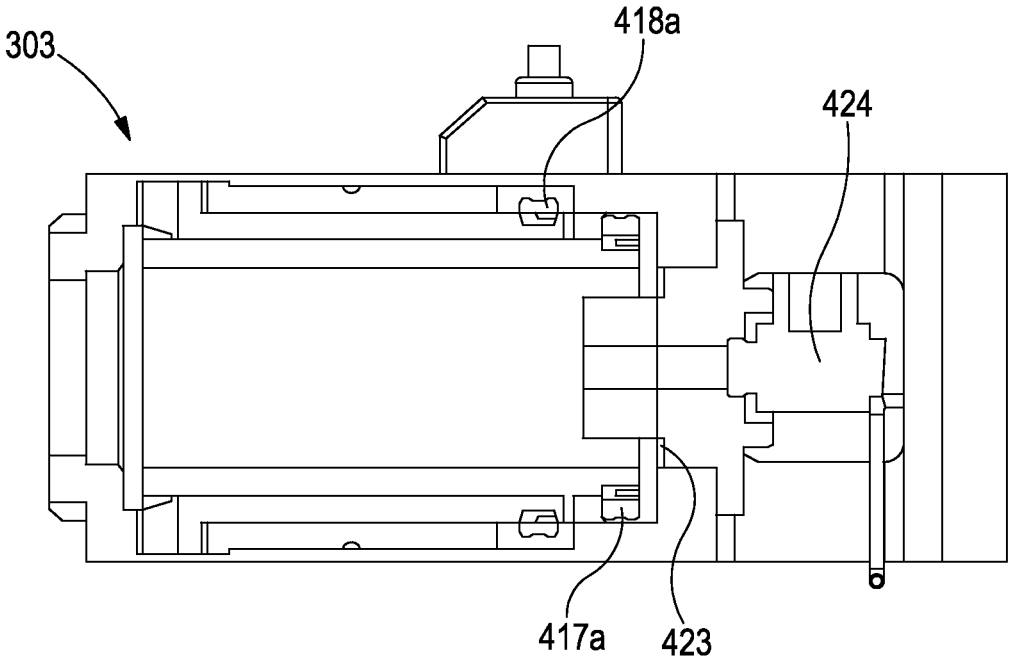
FIG. 5 is a side-on vertical section view through the yoke of FIG. 3.

FIGS. 4 and 5 show, respectively, a horizontal schematic section view and a side-on vertical schematic section view of the of the adjustable yoke 303 shown in FIG. 3.

The alignment mechanism 211 comprises a cylindrical outer housing 416, which is fixed within the main cylindrical bore by a pair of bolts 416*a,b* passing through the side walls of the yoke 303. The end of the cylindrical outer housing 416 adjacent to the front face 303*a* has an outwardly extending rim which is positioned against a cylindrical lip formed in the surface of the main cylindrical bore. The cylindrical outer housing 416 surrounds a pair of eccentrically nested cylindrical bushings, i.e. there is an inner bushing 417 housed within an outer bushing 418. The front end of the outer bushing 418 has an outwardly extending rim which abuts the front end of the cylindrical outer housing 416. The outer bushing 418 extends further (in an axial direction) into the body of the yoke 303 to allow a worm gear 419*a*—fixed to an axle 420*a* extending vertically down through the yoke 303—adjacent to the exterior surface 421 of the outer bushing 418. The worm gear 419*a* is coupled to the exterior surface by a toothed rack 418*a* around that exterior surface. Similarly, the inner bushing 417 extends further (in an axial direction) into the yoke 303 than the outer bushing 418 to allow a second worm gear 419*b*, fixed to a second axle 420*b* extending vertically down through yoke 303, to be coupled to inner bushing 417 by means of a toothed rack 417*a* formed around the exterior surface. A cylindrical collar is provided on the inner bushing 417 immediately adjacent to the rear end of the outer bushing 418 to help maintain the axial position of the inner bushing 417 with respect to the outer bushing 418.

As the adjustable yoke 303 accommodates the alignment mechanism 211, it is likely to be longer than the yokes used in existing bodymakers. This increased length may improve the stability of the adjustable yoke 303 as it moves within the yoke slide 104, thereby improving the stability of the ram 102.

The plug 422 comprises a flange 105 at one end, a cylindrical body and a narrower threaded section at the opposite end to the flange 105. The cylindrical body of the plug 422 is housed within the connecting bore and is slightly smaller than the connecting bore to allow the plug 422 to be offset radially with respect to the yoke 303. The threaded section of the plug extends into the alignment mechanism 211. Ram 102 can be attached to the yoke 303 by screwing the threaded section of the plug 422 into a tapped hole in the end of the ram 102. Before the ram 102 is attached, a washer 423, formed from e.g. a metal such as steel or, another material such as PTFE, may be positioned between the end of the ram 102 and the plug body. Washers of different thicknesses can be used to vary the axial position of the ram 102 with respect to the yoke 303. Other types of insert such as shims can also be used. This type of adjustment can be used to set up the bodymaker 101 more easily as described below. A hole provided through the rear face of the flange 105 and extending through the plug defines a passage into the hollow interior of the ram 102. An adapter 424 is screwed into the hole through the flange 105 to allow the plug 422 to be connected to a source of compressed gas. When the bodymaker 101 is running, a pulse of compressed gas is supplied to the ram 102 to propel the can body from the punch during the return stroke of the ram 102.

As described above, the domed base of the can is formed by carrying the can body on the punch and driving it into the bottom forming tool 107 as the bodymaker 101 completes its forward stroke. The thickness of the base is determined by the distance between the punch and the bottom forming tool 107 when the punch reaches the forward turning point of its motion, i.e. by the minimum separation between the two components, and by the impact force. In known bodymakers, the axial position of the bottom forming tool 107 must be adjusted with respect to the ram 102 in order to obtain the desired thickness. This is typically achieved by inserting an elastomeric pad behind the bottom forming tool 107 to bring the bottom forming tool 107 closer to the punch. Such adjustment may be difficult or inconvenient to carry out.

The mechanism described above (e.g. FIGS. 4 and 5) avoids the need to adjust the axial position of the domer. Instead, the adjustable yoke 303 allows axial adjustment of the yoke-coupled end of the ram 102 with respect to the yoke 303. More generally, the thickness of the can's base can be adjusted by varying the separation between the end of the ram 102 and the drag link 106 of the bodymaker drive mechanism.

The axial adjustment of the ram 102 at the yoke end can also be carried out in a number of other ways, for example by clamping the ram inside the yoke using a hydraulically expanding bush or expanding jaws. For example, the yoke could be provided with a tapped hole, with a screw thread added to the end of the ram 103 to provide an alternative way of screwing the two components together. As a further example, the position of the drag link 106 within the yoke could be adjusted to vary the maximum excursion of the yoke in the yoke slide 104.

Figure 6:
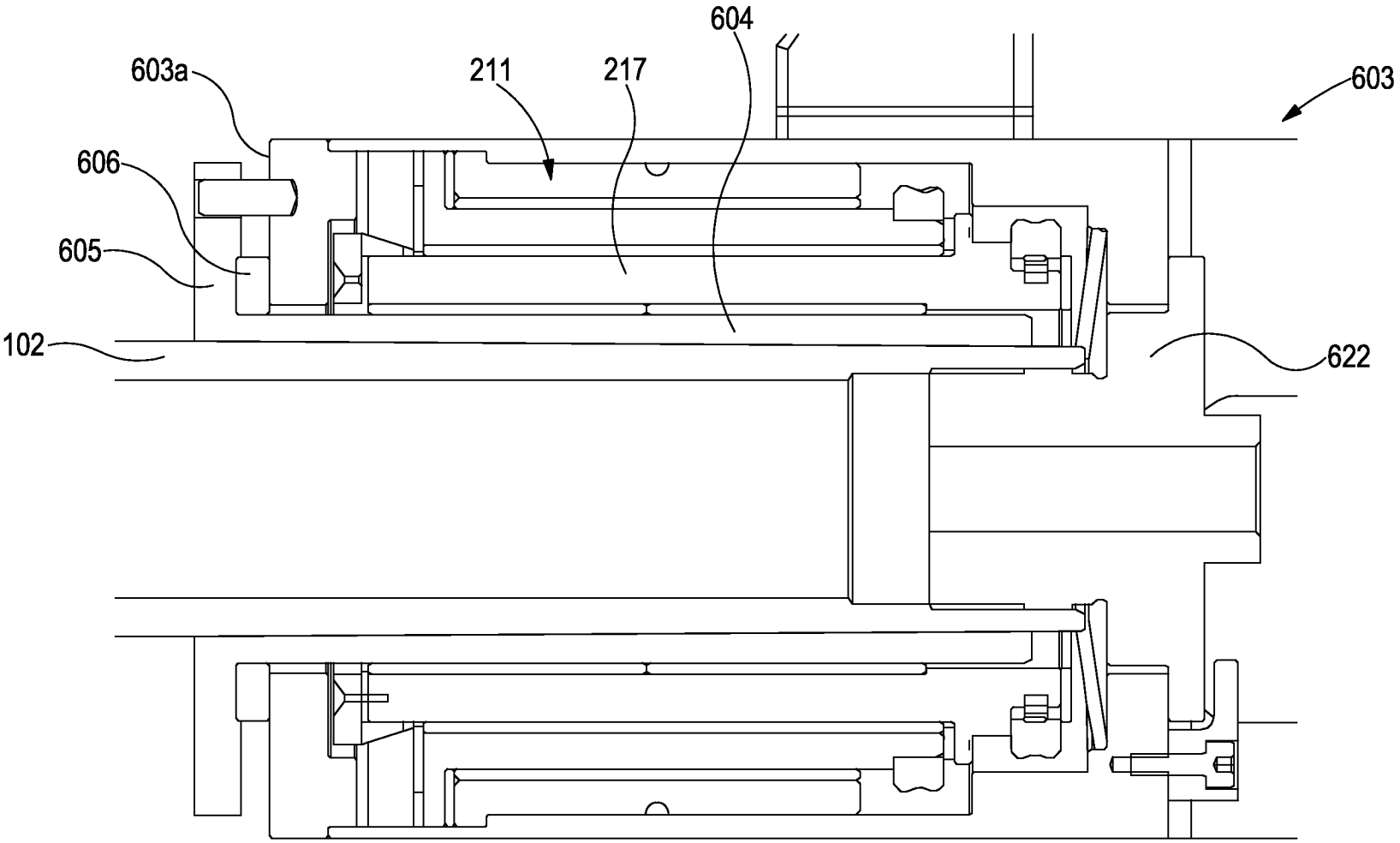
FIG. 6 is a side-on vertical section view through the yoke according to an embodiment of the invention.

FIG. 6 is a side-on vertical section view through another axially adjustable yoke 603 which is similar to the yoke 303 shown in FIG. 3. The yoke 603 comprises a cylindrical alignment mechanism 211 for radial alignment of the ram 102, which is fixed within a sleeve 604, partially inserted into the inner bushing 217 of the alignment mechanism 211 from the front face 603*a* of the yoke 603. The end of the sleeve 604 protrudes from the yoke 603 and has a flange 605 which is separated from the front face 603*a* of the yoke 603 by an insert 606. Inserts 606 of different thicknesses can be used to vary the distance of the flange 605 from the front face 603*a* of the yoke 603 in order to obtain the correct axial alignment of the ram 102. The ram 102 is locked in position by screwing the plug 622 into the ram 102 so that the insert 606 is held in compression between the front face 603*a* of the yoke and the flange 605.

Figure 7:
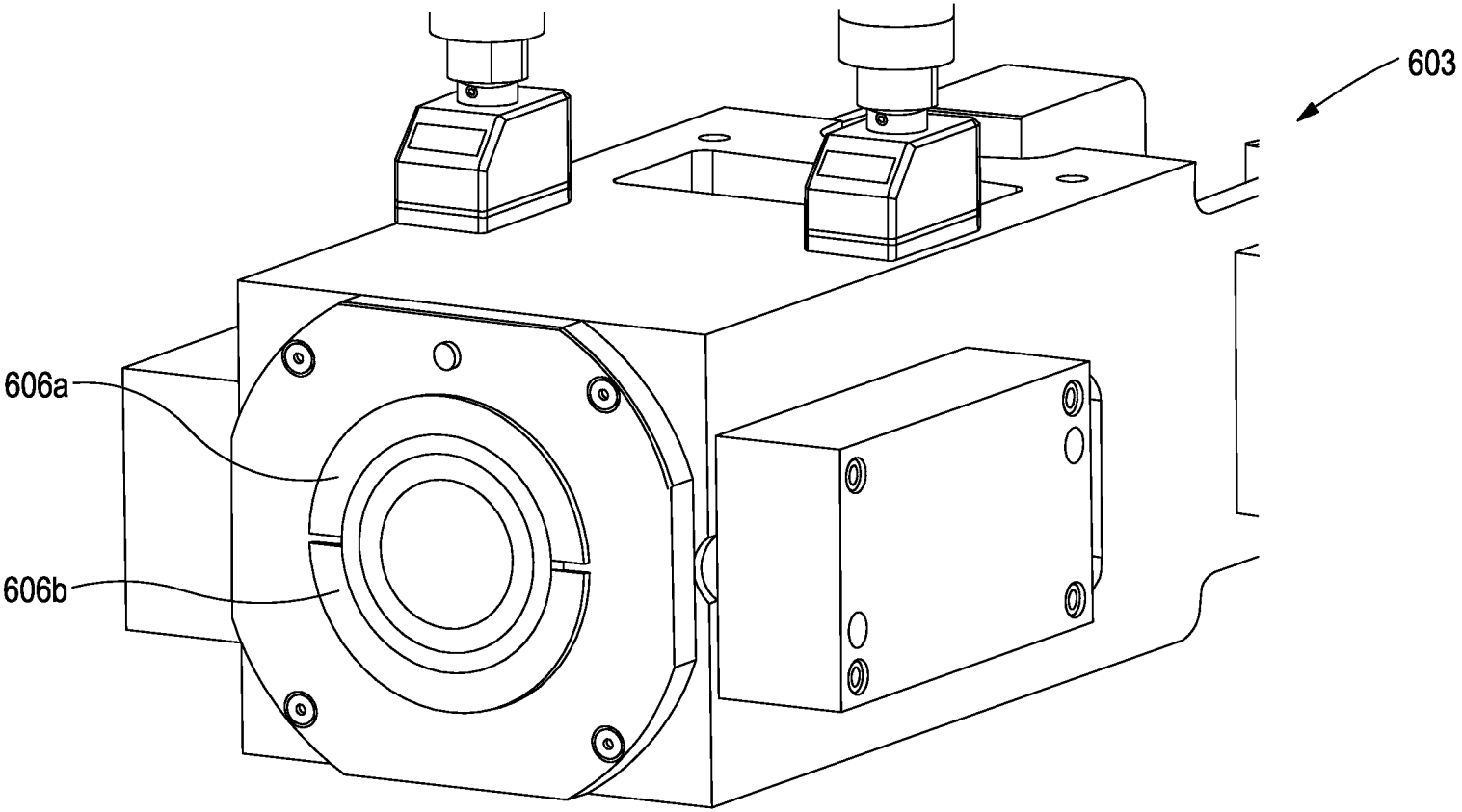
FIG. 7 is a perspective schematic view of the yoke of FIG. 6.

As shown in FIG. 7, in which the ram 102 and the sleeve 604 are not shown, the insert 606 may comprise two C-shaped parts 606*a*, 606*b* which can be fitted around the sleeve 604, or removed, without requiring the ram 102 to be removed from the yoke 603. This allows the insert 606 to be replaced quickly and conveniently when axially aligning the ram 102.

Figure 8:
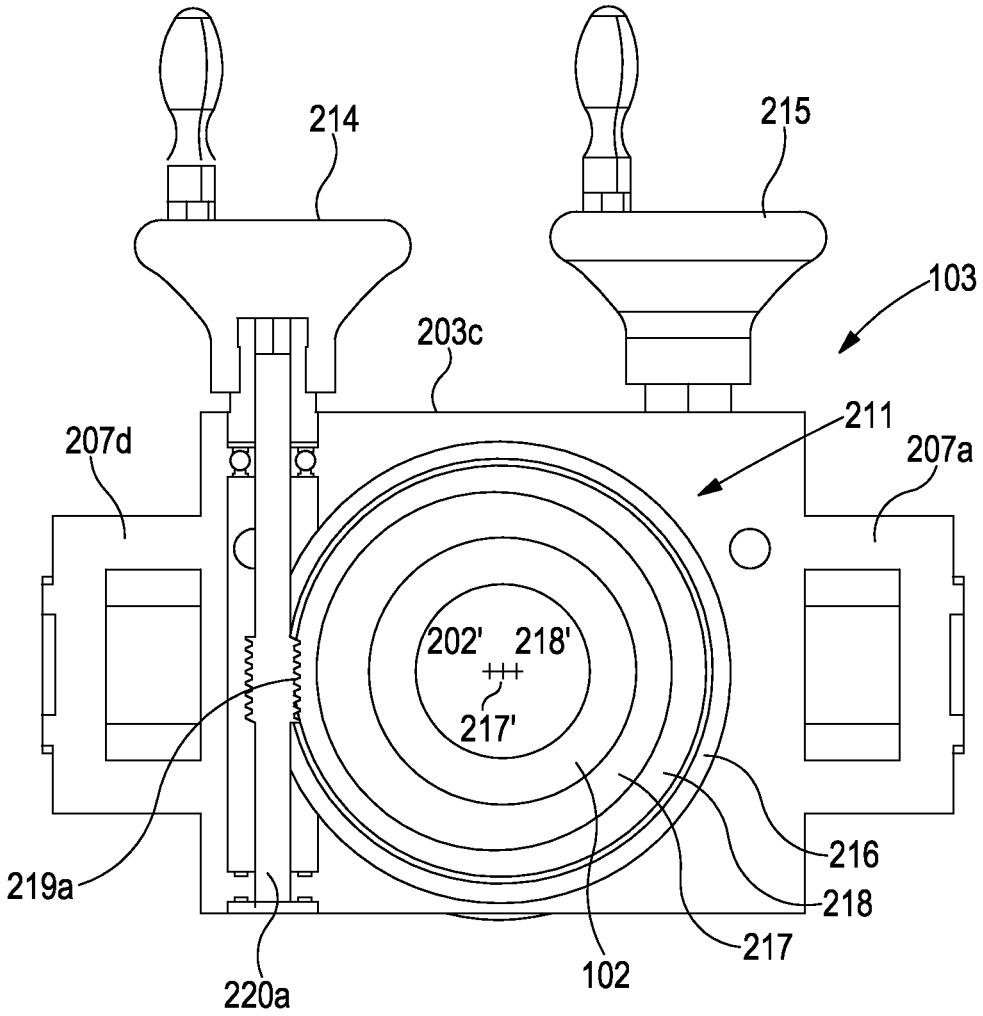
FIG. 8 is an end-on vertical section view through the yoke of FIG. 1.

FIG. 8 shows a vertical section schematic view of the adjustable yoke 103 shown in FIG. 2 taken along the line A-A'. Note that because the ram 102 is hollow it has a ring-shaped cross section in FIG. 8.

Rotating the worm gear 219*a*, which is fixed to an axle 220*a*, causes the outer bushing 218 to rotate within the outer housing 216 about an axis 218'. The outer bushing 218 receives the inner bushing 217 through a cylindrical bore. The bore is located eccentrically within the outer bushing 218 such that rotation of the outer bushing 218 causes the inner bushing 217 to follow a circular path.

Rotating the second worm gear causes the inner bushing 217 to rotate within the outer bushing 218 about an axis 217'. The inner bushing 217 comprises a bore which allows the ram 102 to pass through the alignment mechanism 211. The bore of the inner bushing 217 is arranged eccentrically with respect to the rotation axis 217' so that rotation of the inner bushing 217 causes the ram 102 to move radially along a circular path. The circular path followed by the ram 102 is centred on the circular path of the axis 217' generated by rotating the outer bushing 218. In mathematical terms, the path described by the ram axis 202' following rotation of the outer bushing 218 and then the inner bushing 217 is an epicycle (minor circle) centred on a deferent (major circle) traced by the axis 217'.

The alignment mechanism 211 allows the ram 102 to be positioned within a plane perpendicular to the linear direction defined by the yoke slide 104, by rotating the inner bushing 217 and the outer bushing 218. For example, an iterative procedure can be used in which the inner and outer bushings 217, 218 are rotated in turn until the correct radial position of the ram 102 is achieved. The sensitivity with which the ram 102 may be aligned, and the range of radial positions attainable, is determined by the eccentricities of the inner bushing 217 and the outer bushing 218. The axis of the ram 202 and the axes 217', 218' of the inner and outer bushings 217, 218 are preferably arranged to be parallel.

Figure 9:
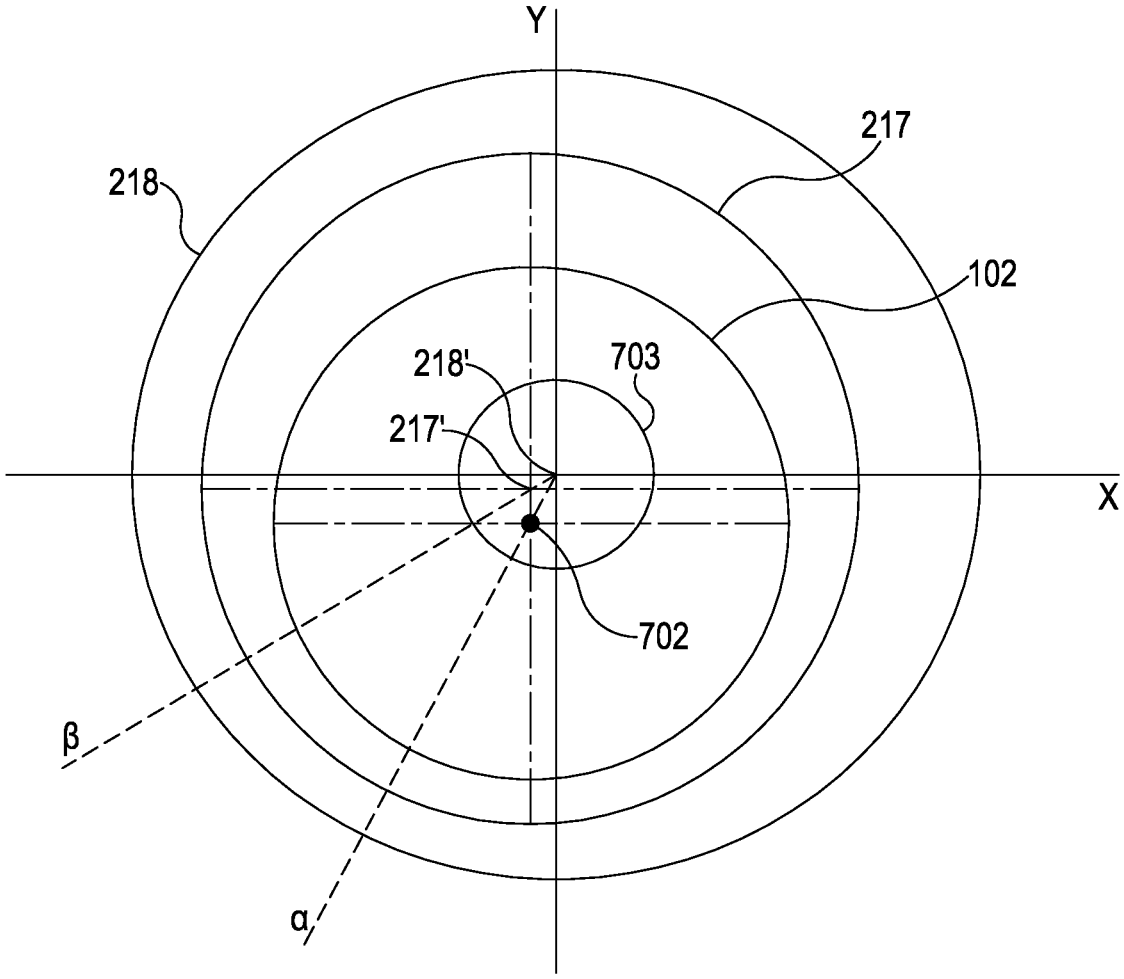
FIG. 9 shows a coordinate system used to understand an alignment mechanism of the yoke of FIG. 1.

FIG. 9 shows X and Y axes centred on the outer bushing 218. A current position of the centre of the ram 102 is indicated by the point 702. This centre point 702 can be moved to any location within the circle 703 by rotating the inner bushing 217 and outer bushing 218 (nb. only the outer circumferences of the inner and outer bushings and the ram are shown in the Figure). The centre position 702 of the ram 102 can be expressed by the following parametric equations:

$$x(t1,t2)=a\cos(\alpha(t1))+b\cos(\beta(t2))$$

$$y(t1,t2)=a\sin(\alpha(t1))+b\sin(\beta(t2));$$

where:

t1 is a parameter for the angular displacement of the inner bushing 217;

t2 is a parameter for the angular displacement of the outer bushing 218;

a is the offset (eccentricity) of the inner bushing 217;

b is the offset (eccentricity) of the outer bushing 218;

$\alpha$ is the angle from the X-axis to the axis 217' of the inner bushing 217; and $\beta$ is the angle from the X-axis to the axis 218' of the outer bushing 218.

The offset "a", or eccentricity, of the inner bushing 217 is the displacement of its axis 217' from the ram centre 702. The offset "b", or eccentricity, of the outer bushing 218 is the displacement of its axis 218' from the axis 217' of the inner bushing. The offset "a" of the inner bushing 218 may be between 0.10 mm and 0.30 mm, and more preferably 0.25 mm. The offset "b" of the outer bushing 217 may be between 0.10 mm and 0.30 mm, and more preferably 0.25 mm. As an example, if "a" is 0.25 mm and "b" is 0.25 mm then the radius of the circular envelope 703 is 0.5 mm.

Figure 10:
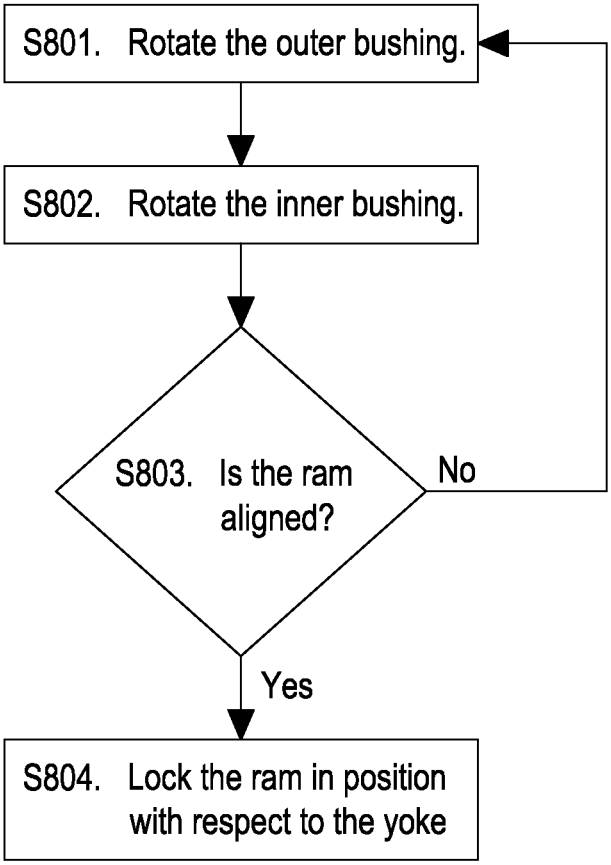
FIG. 10 is a flow chart illustrating a method of setting up the can bodymaker shown in FIG. 1.

FIG. 10 is a flow chart illustrating a method of aligning the ram 102 of the can bodymaker 1 shown in FIG. 1. The outer bushing 18 is rotated S801 and then the inner bushing is rotated S802 to move the ram 102. The inner and outer bushings 217, 218 may then be rotated S801, S802 alternately in an iterative sequence until the ram 102 is aligned, i.e. until the ram 102 is correctly positioned S803 with respect to the yoke 103. The ram 102 may then be locked in position with respect to the yoke 103, e.g. by tightening the lock nut 212.

Figure 11:
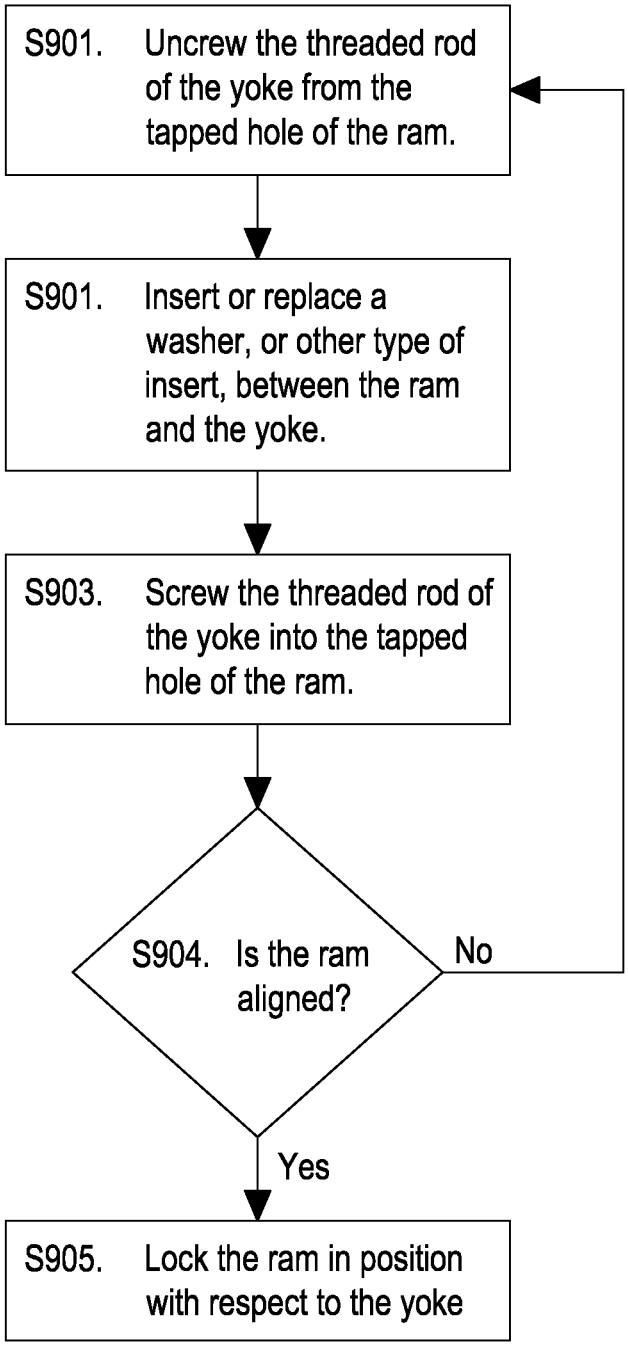
FIG. 11 is a flow chart illustrating a method of setting up the can bodymaker shown in FIG. 1.

FIG. 11 is a flow chart illustrating a method of adjusting the ram 102 of the can bodymaker 1 shown in FIG. 1. The plug 422 of the yoke 303 is unscrewed S901 from the tapped hole in the ram 102. A washer 423 is inserted S902 over the threaded section of the plug 422. Alternatively, if there is already a washer 423 in place, this washer 423 may be replaced S902 by a washer with a different thickness or a different material. The plug 422 is then screwed S903 into the ram 102 so that the washer 423 is trapped between the yoke 303 and the ram 102. A determination of whether the ram is aligned is then made S904. For example, the can bodymaker may be operated to observe whether the alignment of the ram produces cans with a correct base thickness. This may involve a manual inspection of the cans being produced, or may make use of sensors arranged within the domer station. If the ram 102 is not aligned, then the adjustment process S901-S903 may be repeated using a different washer 423. Once the ram 102 is aligned, it may be locked in position S905 with respect to the yoke 303, e.g. by tightening the lock nut 212.

It will be understood by the person of skill in the art that various modifications may be made to the above described embodiments without departing from the scope of the present invention. For example, although the invention has been described with reference to a pair of nested eccentric bushings, more than two nested eccentric bushings could be used. It is also possible to use an alternative to the two nested bushings described above. For example, the ram 102 may be positioned within the yoke 103, 303 using a set of mounting screws that are moved into and out of the yoke. In a further alternative, the ram 102 may be mounted in a single bushing, the bushing being movable within the yoke 103, 303 by means of a set of adjustable cams, a set of hydraulic pistons or a set of moveable wedges.

The invention claimed is:

1. A can bodymaker comprising:

a ram;

a drive mechanism configured to drive the ram in a linear, reciprocating motion;

a yoke coupling the ram to the drive;

a yoke slide fixed relative to the can bodymaker, the yoke being confined by the yoke slide to move in a linear direction; and an alignment mechanism configured to radially align a yoke-coupled end of the ram with respect to the yoke within a plane perpendicular to said linear direction, the alignment mechanism comprising:

an inner bushing supporting the ram, the inner bushing being annular and having eccentric inner and outer surfaces;

an outer bushing supporting the inner bushing, the outer bushing being annular and having eccentric inner and outer surfaces;

an adjustment mechanism for independently rotating the inner and outer bushings about respective axes of rotation defined by their outer surfaces; and a lock that is adapted for affixing the yoke-coupled end of the ram in position relative to the yoke, thereby diminishing load on the alignment mechanism, the lock comprising a compression coupling arranged axially about the inner and outer bushings.

2. The can bodymaker according to claim 1, wherein the axes of rotation of the inner and outer bushings are separated by a distance between 0.10 mm and 0.30 mm.

3. The can bodymaker according to claim 1, wherein an axis of the ram and the rotational axis of the inner bushing are separated by a distance between 0.10 mm and 0.30 mm.

4. The can bodymaker according to claim 1, the adjustment mechanism comprising a first worm gear for rotating the inner bushing and a second worm gear for rotating the outer bushing.

5. The can bodymaker according to claim 1, wherein the compressing coupling comprises a nut for locking the ram in position with respect to the yoke, the nut being threaded on to the ram.

6. The can bodymaker according to claim 1, wherein said yoke allows adjustment of the yoke-coupled end of the ram with respect to the drive mechanism along said linear direction.

7. The can bodymaker according to claim 6, wherein said yoke is coupled to the ram by a threaded rod screwed into a tapped hole, the yoke allowing adjustment of the yoke-coupled end of the ram with respect to the drive mechanism along said linear direction by screwing the threaded rod into or out of the tapped hole.

8. The can bodymaker according to claim 6, further comprising an insert located between the yoke-coupled end of the ram and the yoke, the insert being formed from an elastomeric material.

9. The can bodymaker according to claim 1, further comprising a bottom forming tool located at an end of the can bodymaker opposite the drive mechanism.

10. A can bodymaker according to claim 1, wherein the alignment mechanism is adapted for affixing the yoke-coupled end of the ram with respect to the yoke within the plane perpendicular to said linear direction.

11. A method of aligning a ram of a can bodymaker having a yoke coupling the ram to a drive mechanism in order to drive the ram with a linear, reciprocating motion, and where a yoke slide is fixed relative to the can bodymaker and the yoke is confined by the yoke slide to move in a linear direction, the method comprising positioning, with an alignment mechanism, a yoke-coupled end of the ram with respect to the yoke within a plane perpendicular to said linear direction; wherein the use of the alignment mechanism comprises rotating one or more of a pair of eccentrically nested bushings; and locking the yoke-coupled end of the ram in position relative to the yoke via a compression coupling arranged axially about the eccentrically nested bushings.

12. The method according to claim 11, further comprising alternately rotating the eccentrically nested eccentric bushings in an iterative sequence.

13. A yoke for a can bodymaker and configured to couple a ram to a drive mechanism, the drive mechanism being configured to drive the ram with a linear, reciprocating motion, the yoke being further configured to fit within a yoke slide so that the yoke is confined to move in a linear direction, the yoke comprising a radial alignment mechanism for aligning a yoke-coupled end of the ram with respect to the yoke within a plane perpendicular to said linear direction, the alignment mechanism comprising:

an inner bushing for supporting the ram, the inner bushing being annular and having eccentric inner and outer surfaces;

an outer bushing supporting the inner bushing, the outer bushing being annular and having eccentric inner and outer surfaces;

an adjustment mechanism for independently rotating the inner and outer bushings about respective axes of rotation defined by their outer surfaces; and a lock that is adapted for affixing the yoke-coupled end of the ram in position relative to the yoke, thereby diminishing load on the alignment mechanism the lock comprising a compression coupling arranged axially about the inner and outer bushings.

* * * * *